US010246670B2

(12) United States Patent
Imura et al.

(10) Patent No.: US 10,246,670 B2
(45) Date of Patent: Apr. 2, 2019

(54) AZEOTROPE-LIKE COMPOSITION CONTAINING FLUORINATED OLEFIN AS COMPONENT

(71) Applicant: Central Glass Company, Limited, Ube-shi, Yamaguchi (JP)

(72) Inventors: Hideaki Imura, Fujimino (JP); Naoto Takada, Saitama (JP)

(73) Assignee: Central Glass Company, Limited, Ube-shi (JP)

( * ) Notice: Subject to any disclaimer, the term of this patent is extended or adjusted under 35 U.S.C. 154(b) by 50 days.

(21) Appl. No.: 15/547,578

(22) PCT Filed: Jan. 14, 2016

(86) PCT No.: PCT/JP2016/050903
§ 371 (c)(1),
(2) Date: Jul. 31, 2017

(87) PCT Pub. No.: WO2016/125550
PCT Pub. Date: Aug. 11, 2016

(65) Prior Publication Data

US 2018/0265821 A1 Sep. 20, 2018

(30) Foreign Application Priority Data

Feb. 2, 2015 (JP) ..... 2015-018341

(51) Int. Cl.
*C11D 7/50* (2006.01)
*D06F 35/00* (2006.01)
*C23G 5/028* (2006.01)

(52) U.S. Cl.
CPC ..... *C11D 7/5045* (2013.01); *C11D 7/50* (2013.01); *C23G 5/028* (2013.01); *D06F 35/00* (2013.01)

(58) Field of Classification Search
CPC ..... C11D 7/50; C11D 7/5045
(Continued)

(56) References Cited

U.S. PATENT DOCUMENTS

2005/0096246 A1* 5/2005 Johnson ..... C11D 3/43 510/407
2010/0004155 A1 1/2010 Ishihara et al.
(Continued)

FOREIGN PATENT DOCUMENTS

JP 2-221388 A 9/1990
JP 2-221389 A 9/1990
(Continued)

OTHER PUBLICATIONS

International Search Report (PCT/ISA/210) issued in PCT Application No. PCT/JP2016/050903 dated Apr. 5, 2016 with English-language translation (five (5) pages).
(Continued)

*Primary Examiner* — Gregory E Webb
(74) *Attorney, Agent, or Firm* — Crowell & Moring LLP

(57) ABSTRACT

What is disclosed is a liquid composition containing: 80 mol % to 99.9999 mol % of (Z)-1,2-dichloro-3,3,3-trifluoropropene (1223Z) and 0.0001 mol % to 20 mol % of (E)-1,2-dichloro-3,3,3-trifluoropropene (1223E). The liquid composition has small impact on the global environment and exerts azeotrope-like properties. Therefore, the composition of the liquid composition is not substantially changed even when the liquid composition is used in an open system or used for a long period. The composition of the liquid composition is also rarely changed even when the liquid composition is recovered by distillation. Therefore, the liquid mixture according to the present invention can be used suitably as a cleaning agent (a solvent).

9 Claims, 1 Drawing Sheet

(58) Field of Classification Search
USPC ..... 510/415; 252/68
See application file for complete search history.

(56) References Cited

U.S. PATENT DOCUMENTS

| | | | | |
|---|---|---|---|---|
| 2012/0065437 | A1* | 3/2012 | Merkel | B01J 27/10 570/175 |
| 2012/0123173 | A1 | 5/2012 | Hibino et al. | |
| 2012/0138841 | A1 | 6/2012 | Hulse et al. | |
| 2014/0357907 | A1 | 12/2014 | Okamoto et al. | |
| 2015/0191405 | A1 | 7/2015 | Nishiguchi et al. | |
| 2015/0191406 | A1 | 7/2015 | Nishiguchi et al. | |
| 2017/0321167 | A1* | 11/2017 | Imura | C11D 7/30 |

FOREIGN PATENT DOCUMENTS

| | | | |
|---|---|---|---|
| JP | 2-221962 | A | 9/1990 |
| JP | 2-222469 | A | 9/1990 |
| JP | 2-222496 | A | 9/1990 |
| JP | 2-222702 | A | 9/1990 |
| JP | 2008-133438 | A | 6/2008 |
| JP | 2011-42646 | A | 3/2011 |
| JP | 2010-248443 | A | 11/2012 |
| JP | 2013-87187 | A | 5/2013 |
| JP | 2013-249326 | A | 12/2013 |
| JP | 2014-507486 | A | 3/2014 |
| JP | 2014-210765 | A | 11/2014 |
| WO | WO 2014/046250 | A1 | 8/2016 |
| WO | WO 2014/046251 | A | 8/2016 |

OTHER PUBLICATIONS

Japanese-language Written Opinion (PCT/ISA/237) issued in PCT Application No. PCT/JP2016/050903 dated Apr. 5, 2016 (four (4) pages).

Japanese-language Office Action issued in counterpart Japanese Application No. 2015-018341 dated Jul. 10, 2018 (five (5) pages).

* cited by examiner

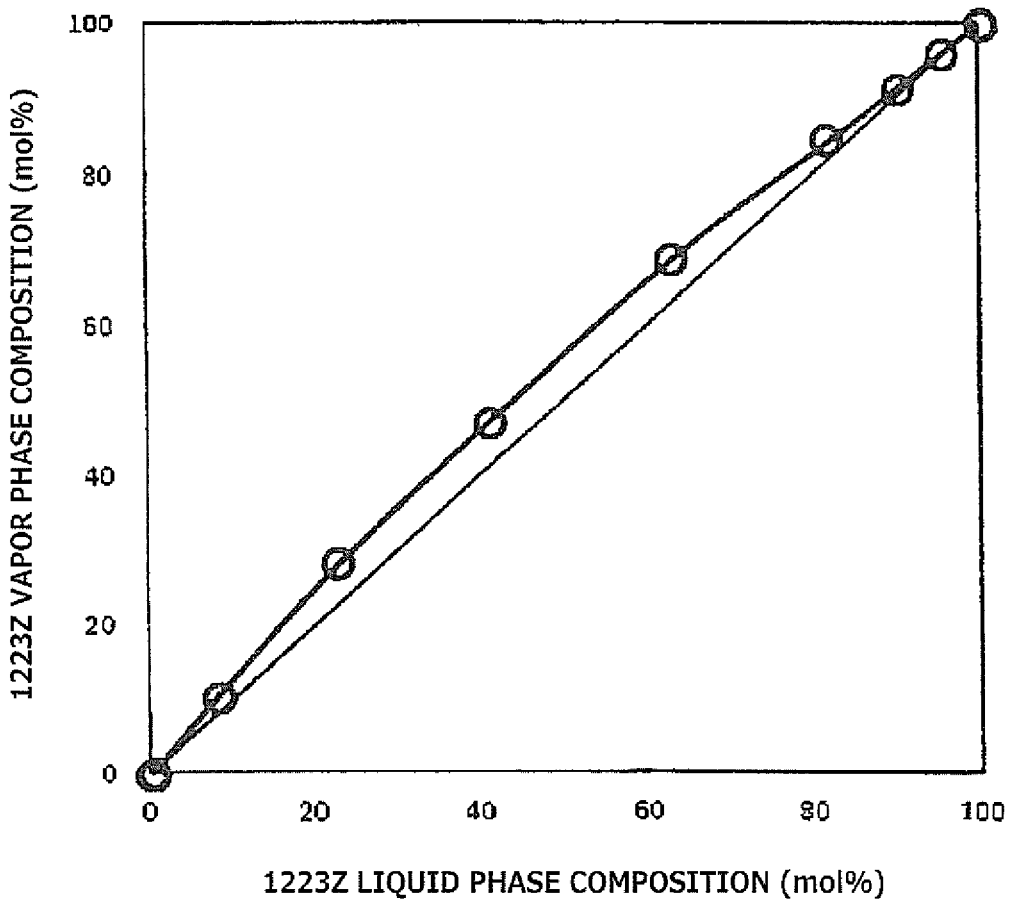
100
80
60
40
20
0
0
20
40
60
80
100
1223Z VAPOR PHASE COMPOSITION (mol%)
1223Z LIQUID PHASE COMPOSITION (mol%)

AZEOTROPE-LIKE COMPOSITION CONTAINING FLUORINATED OLEFIN AS COMPONENT

TECHNICAL FIELD

The present invention relates to a novel composition containing a fluorinated olefin.

BACKGROUND ART

It is known that fluorinated alkanes of 1 to 5 carbon atoms, such as chlorofluorocarbons (hereinafter sometimes referred to as "CFCs"), hydrochlorofluorocarbons (sometimes referred to as "HCFCs") and hydrofluorocarbons (sometimes referred to as "HFCs"), show volatility, stability, and non-flammability. Therefore, these fluorinated alkanes (sometimes referred to as "Freons") have been used as refrigerants, working fluids, foaming agents, sprays, cleaning agents, dissolving agents, solvents, etc. and made contributions to industrial developments. Furthermore, these fluorinated alkanes have been widely used as blends of two or more kinds thereof. For example, there were commonly used mixed refrigerants R502, R507A, R404A, R407C and R401A according to the American Society of Heating, Refrigerating and Air-Conditioning Engineers (ASHRAE) standards. The above mixed refrigerants are each prepared by mixing two or more kinds of Freons at a specific ratio for improvements in coefficient of performance, refrigeration cycle, non-flammability, global warming potential and the like. However, because of the volatility of the fluorinated alkanes, there occurs a composition change in the mixture by evaporation of any one of the Freons during use. The physical properties of the mixture vary due to such a composition change. Therefore, it is preferable to form an azeotrope or azeotrope-like composition in that the vapor phase produced by volatilization has the same or substantially the same composition as does the liquid phase. The above-mentioned refrigerant R502 (that is, a mixed refrigerant of R22 and R115) and refrigerant R507A (that is, a mixed refrigerant of R143a and R125) are known as azeotrope refrigerants because each of these refrigerants is in the form of an azeotrope mixture having vapor and liquid phase of exactly the same composition. The above-mentioned refrigerant R410A is known as an azeotrope-like refrigerant because its constituent components R32 and R125 do not form an azeotrope composition but form a mixture having vapor and liquid phases of substantially the same composition so that this mixture can be handled in practically the same manner as the azeotrope composition. The applications other than the refrigerant applications include water removing agents each prepared by blending a fluorinated alkane with an alcohol, and cleaning agents each prepared by adding a non-flammable fluorinated alkane to a flammable hydrocarbon solvent so as to achieve non-flammability and controlled cleaning power. Even in these applications of water removing and cleaning agent, as in the case of the refrigerant applications, it is preferable to form an azeotrope or azeotrope-like composition where the vapor phase produced by volatilization has the same or substantially the same composition as does the liquid phase.

It is also known that the fluorinated alkanes as mentioned above are very stable in the air and long in atmospheric lifetime and become a cause of global warming. For these reasons, fluorinated olefins of 2 to 5 carbon atoms (such as hydrofluoroolefins, hydrochlorofluoroolefins, chlorofluoroolefins, and fluoroolefins) have recently been proposed as substitutes for the above fluorinated alkanes. The fluorinated olefins, each of which has a double bond in the molecule, shows significantly high reactivity to OH radicals in the air as compared to the fluorinated alkanes with no double bond. The atmospheric lifetime of the fluorinated olefins is generally in days, whereas the atmospheric lifetime of the commonly used fluorinated alkanes such as HFC-365mfc, HFC-245fa and HFC-43-10 is in years. The fluorinated olefins, even if released into the air, get quickly decomposed and have less influence of global warming, ozone depletion, etc. Furthermore, it is reported that the fluorinated olefins have similar physical properties as those of the fluorinated alkanes and can be used for various applications such as refrigerants, working fluids, foaming agents, sprays, cleaning agents, dissolving agents, solvents, etc.

The fluorinated olefins can be improved in performance by blending other chemical species therewith as in the case of the fluorinated alkanes. For example, Patent Document 1 teaches that: an azeotrope-like binary solvent is formed by mixing (Z)-1-chloro-3,3,3-trifluoropropene with 1,1,2,2-tetrafluoro-1-methoxyethane; and the thus-formed binary solvent has good cleaning effect on various oils. However, specific reports on azeotrope or azeotrope-like compositions of fluorinated olefins are few in number as compared to those of fluorinated alkanes. Furthermore, documents about an azeotrope or azeotrope-like composition where fluorinated olefins are combined with each other are lesser in number.

Patent Document 2 has proposed a mixture of a fluorinated olefin of 3 carbon atoms and a general-purpose solvent. In Example 4 of Patent Document 2, a degreasing test of 1,2-dichloro-3,3,3-trifluoropropene alone has been disclosed. However, there is no description about geometrical isomer (E-isomer, Z-isomer) of 1,2-dichloro-3,3,3-trifluoropropene. Patent Documents 3 to 7 teach a resist remover, a buffing agent, an adhesive moisture removing solvent, and a dry cleaning agent relating to 1,2-dichloro-3,3,3-trifluoropropene, but give no description about the geometric isomers of 1,2-dichloro-3,3,3-trifluoropropene as in the case of Patent Document 2.

PRIOR ART DOCUMENTS

Patent Documents

Patent Document 1: Japanese Patent Application Publication No. 2008-133438

Patent Document 2: Japanese Patent Application Publication No. 02-221388

Patent Document 3: Japanese Patent Application Publication No. 02-221962

Patent Document 4: Japanese Patent Application Publication No. 02-221389

Patent Document 5: Japanese Patent Application Publication No. 02-222469

Patent Document 6: Japanese Patent Application Publication No. 02-222496

Patent Document 7: Japanese Patent Application Publication No. 02-222702

SUMMARY OF THE INVENTION

Problems to be Solved by the Invention

As discussed above, the volatile solvent composition can be improved in performance by simply mixing a plurality of solvents, but cannot avoid the problem that a liquid composition change is likely to occur due to the volatility of the respective components. For example, when the binary liquid composition is used for cleaning in an ultrasonic cleaning machine, the low boiling component (i.e. high vapor pressure component) is generally preferentially volatilized so that the high boiling component (i.e. low vapor pressure component) is concentrated in a cleaning tank. In the case of using the low boiling component of high cleaning power and the high boiling component of low cleaning power, there may arises the problem of insufficient cleaning as the amount of the low boiling component in the liquid composition decreases with time. Furthermore, the used cleaning liquid is generally recovered and reused by distillation operation. However, it is necessary to adjust the liquid composition of the recovered cleaning liquid, which is not efficient in operation, in the case where the liquid phase is different in composition from the vapor phase. Furthermore, the non-flammable composition may not only vary in cleaning effect, but also change to a flammable composition due to a liquid composition change by volatilization of the composition during use.

For that reason, it is strongly demanded to form an azeotrope or azeotrope-like composition where the vapor phase produced by volatilization has the same or substantially the same composition as does the liquid phase. It is accordingly an object of the present invention to provide a novel azeotrope or azeotrope-like composition that contains environment-friendly (Z)-1,2-dichloro-3,3,3-trifluoropropene and (E)-1,2-dichloro-3,3,3-trifluoropropene, and causes no composition change by volatilization.

Means for Solving the Problems

The present inventors have made extensive researches to solve the above problems. As a result of the extensive researches, it has been found that: a composition containing 80 mol % to 99.9999 mol % of Z-isomer of 1,2-dichloro-3,3,3-trifluoropropene (hereinafter it may be referred to as "HCFO-1223xd(Z)" or "1223Z") and 0.0001 mol % to 20 mol % of E-isomer of 1,2-dichloro-3,3,3-trifluoropropene (hereinafter it may be referred to as "HCFO-1223xd(E)" or "1223E") is an azeotrope-like composition where the vapor and liquid phases are substantially the same in composition; and a non-flammable material (non-hazardous material) with no-flash point under the Fire Serves Act. Furthermore, it has been confirmed that the azeotrope-like composition according to the present invention is useful as a degreasing agent (cleaning agent) of oil, etc. The present invention is based on these findings.

Namely, the present invention involves the following inventive aspects.

[Inventive Aspect 1]

An azeotrope (or azeotrope-like) composition comprising (Z)-1,2-dichloro-3,3,3-trifluoropropene (1223Z) and (E)-1,2-dichloro-3,3,3-trifluoropropene (1223E).

[Inventive Aspect 2]

The azeotrope (or azeotrope-like) composition according to Inventive Aspect 1, wherein the azeotrope (or azeotrope-like) composition contains 80 mol % to 99.9999 mol % of 1223Z and 0.0001 mol % to 20 mol % of 1223E.

[Inventive Aspect 3]

The azeotrope (or azeotrope-like) composition according to Inventive Aspect 1 or 2, wherein the azeotrope (or azeotrope-like) composition contains 90 mol % to 99.9999 mol % of 1223Z and 0.0001 mol % to 10 mol % of 1223E.

[Inventive Aspect 4]

A liquid composition comprising the azeotrope (or azeotrope-like) composition according to any one of Inventive Aspects 1 to 3 and at least one additional component.

[Inventive Aspect 5]

A liquid composition comprising the azeotrope (or azeotrope-like) composition according to any one of Inventive Aspects 1 to 3 and 10 ppm to 30 mass % of at least one additional component relative to a total amount of the azeotrope (or azeotrope-like) composition.

[Inventive Aspect 6]

A solvent for cleaning, comprising the azeotrope (or azeotrope-like) composition or liquid composition according to any one of Inventive Aspects 1 to 5.

[Inventive Aspect 7]

A method for cleaning a cleaning target object, comprising bringing the azeotrope (or azeotrope-like) composition or liquid composition according to any one of Inventive Aspects 1 to 5 into contact with the cleaning target object.

Effects of the Invention

According the present invention, it is possible to provide the novel azeotrope (or azeotrope-like) composition. The composition has the effect that a composition change is less likely to be caused even when used in an open condition. Furthermore, the azeotrope (or azeotrope-like) composition gives less load on the environment and is classified as a non-flammable material (non-hazardous material) under the Fire Serves Act. Furthermore, the azeotrope (or azeotrope-like) composition is useful as a solvent (cleaning agent) for cleaning away a contaminant such as foreign matter, oil and fat.

BRIEF DESCRIPTION OF THE DRAWING

FIG. 1 is a vapor-liquid equilibrium diagram of (Z)-1,2-dichloro-3,3,3-trifluoropropene (1223Z) and (E)-1,2-dichloro-3,3,3-trifluoropropene (1223E).

DETAILED DESCRIPTION OF THE EMBODIMENTS

As the fluorinated olefin shows high compatibility with various solvents, it is relatively easy to form a uniform composition of a fluorinated olefin. However, in case of a composition having arbitrary compositions, the problem that "liquid composition change is likely to be caused" exists. Namely, the composition, when prepared by mixing a plurality of liquids while ensuring compatibility, cannot avoid the problem that a liquid composition change is likely to occur due to the volatility of the respective components. For example, when the binary liquid composition is used as a cleaning agent in an ultrasonic cleaning machine, the high volatile and low boiling component (i.e. high vapor pressure component) is generally preferentially volatilized so that the low volatile and high boiling component (i.e. low vapor pressure component) is concentrated in a cleaning tank. For example, in case of using the low boiling component of high cleaning power and the high boiling component of low cleaning power, there may arises the problem of insufficient cleaning as the amount of the low boiling component in the cleaning agent decreases with time. In case of preparing the cleaning agent as a non-flammable composition by blending the non-flammable solvent with the flammable solvent, the cleaning agent may change to a flammable composition by preferential volatilization of the non-flammable component.

Furthermore, in terms of environmental protection and cost efficiency, it is desirable to recover and reuse the used cleaning agent by distillation operation, etc. However, in the case of a liquid including a binary system, the two liquid components of different boiling points generally need to be separately recovered. Thus, this recovery and reusing operation tends to cause an operational burden.

The same problem arises when the liquid composition is used as a working fluid in a thermodynamic cycle. Namely, there is a possibility of a liquid composition change during long-term use when the liquid composition is used as the working fluid in the thermodynamic cycle. The heat capacity, viscosity or lubricating oil affinity of the liquid composition varies due to such a liquid composition change. This can lead a deterioration in the working performance of the thermodynamic cycle.

The binary (multicomponent) liquid composition, when used as the cleaning agent or the working fluid, has to be frequently analyzed and constantly maintained within a proper composition range by mixing the components at an appropriate ratio and adding the volatilized component. However, such liquid composition management becomes a large operational burden.

By contrast, an azeotrope composition is particularly preferred in that the vapor phase caused by vaporization has the same composition as does the liquid phase whereby there is unlikely to occur a liquid composition change during use. In the present description, the term "azeotrope" is used in the thermodynamically exact sense. For example, a liquid mixture of ethanol (96 mass %) and water (4 mass %) is an azeotrope mixture (azeotrope) in that the vapor in equilibrium with the liquid also has a composition of ethanol (96 mass %) and water (4 mass, i.e. the vapor and liquid phases are exactly the same in composition. The term "azeotrope" is used to refer to such a phenomenon. Under a specific temperature and pressure, the azeotrope exists only at one composition point.

The term "azeotrope-like" is also called as "quasi-azeotrope". There is a case where a liquid mixture of certain composition range may show a phenomenon in which the vapor and liquid phases in equilibrium are substantially the same in composition even though it is not azeotropic in the thermodynamically exact sense. This mixture can be handled in the same manner as the azeotrope mixture as long as the vapor and liquid phase in equilibrium are substantially the same in composition but not exactly the same in composition. In that, it is preferable that the difference between the compositions of the vapor and liquid phases in equilibrium is as small as possible. The term "azeotrope-like" or "quasi-azeotrope" is used to refer to the phenomenon in which the vapor and liquid phases in equilibrium are substantially the same in composition. The composition showing such a phenomenon is referred to as "azeotrope-like or quasi-azeotrope composition".

In academic fields, the terms "azeotrope" and "azeotrope-like (or quasi-azeotrope)" should be distinguished. However, in practical use such as cleaning, there is no need to distinguish the terms "azeotrope" and "azeotrope-like (or quasi-azeotrope)" because the azeotrope composition and the azeotrope-like (or quasi-azeotrope) composition can be handled in the same manner. For this reason, the terms "azeotrope" and "azeotrope-like (or quasi-azeotrope)" are collectively referred to as "azeotrope (or azeotrope-like)" in the present description. The azeotrope or azeotrope-like composition is referred to as "azeotrope (or azeotrope-like) composition".

It does not matter whether or not the azeotrope (or azeotrope-like) composition has an azeotrope point. The azeotrope (or azeotrope-like) composition can be any composition in which the vapor and liquid phases in equilibrium are substantially the same in composition.

The azeotrope-like composition is not derived based on theory, but is found out for the first time at the time when, during experimental researches on various kinds and composition ratios of liquids, the compositions of the vapor and liquid phases becomes substantially identical. According to the present invention, regarding to E-isomer (1223E) and Z-isomer (1223Z) of 1,2-dichloro-3,3,3-trifluoropropene, the composition in which the vapor and liquid phases are substantially same in terms of composition in a specific region has been found. Especially, 1223Z and 1223E are quite different from each other in terms of a boiling point and polarity, so it is very difficult to guess that these are to be azeotrope-like. The boiling point and polarity (dipole moment (B3LYP/6-311+G** calculated value)) of each compound are as follows.

[Chemical formula 1]

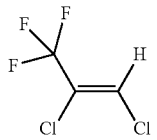

Z-1,2-dicholoro-3,3,3-trifluoropropene (1223Z)
Boiling point: 53° C.
Dipole moment: 1.74 debye

[Chemical formula 2]

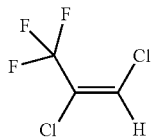

E-1,2-dicholoro-3,3,3-trifluoropropene (1223E)
Boiling point: 60° C.
Dipole moment: 2.54 debye Production methods of 1223Z and 1223E have been described in the patent documents (JP2014-210765, WO2014/046250, WO2014/046251). That is, 1223Z and 1223E can be obtained as mixture compounds in which both exist generally in equilibrium state or near the equilibrium state by reacting 1,2-dichloro-3,3,3-trifluoropropene and chlorine in a vapor phase.

In case that both of 1223Z and 1223E are generated as 1,2-dichloro-3,3,3-trifluoropropene, a mixture containing both components can be purified by a purification treatment. For example, it is possible to conduct a precision distillation by a distillation column having a theoretical plate number of 30 to 300. A distillation column having a lot of plate numbers can give high purification in a good yield by one operation. For example, by redistilling a high-purity fraction with a distillation column having 50 plates, a fraction substantially containing no reciprocal isomer can be obtained. It is effective to conduct an auxiliary distillation in advance before the precision distillation.

The high-purity fraction of 1223Z obtained by the precision distillation is conducted to an adsorption treatment with activated carbon, zeolite, etc., thereby can be further refined. Specifically, it is preferable that the adsorption treatment is conducted after 1223Z is concentrated to a concentration of 99.9% or more by a distillation process. It is possible also to use an existing separating/purifying method where differences in reactivity and polarity between 1223Z and 1223E are utilized. For example, 1223Z containing impurities is made to contact with a basic aqueous solution or sulfuric acid and stirred, thereby the impurities can be decomposed. In particular, in case of stirring it with the basic aqueous solution, to stir with a phase transfer catalyst is peculiarly efficient. Furthermore, to combine these purifying methods is also effective.

After 1223Z and 1223E substantially not containing other ingredients are isolated, they are mixed at a predetermined ratio. Thereby, "the azeotrope or azeotrope-like composition containing 1223Z and 1223E" of the present invention can be obtained. According to this way, for example, the azeotrope (or azeotrope-like) composition containing 99.9999 mol % of 1223Z and 0.0001 mol % of 1223E can also be prepared.

Furthermore, as an alternative way, a mixture in which 1223Z and 1223E exist in near equilibrium state (a composition in which 1223E is a main component and in which 1223Z is a minor component) is subjected to, for example, the precision distillation in about 50 to 100 plates, and thereby fractions where the concentration of 1223Z is 80 mol % or more (the concentration of 1223E is 20 mol % or less) can be obtained. In this case, a distillation condition (peculiarly, the distillation plate number) may properly be adjusted so as to obtain a distillate containing the desired compositions, and no process of mixing a pure 1223Z and 1223E again is required unlike the above-mentioned way.

However, "a composition in which the concentration of 1223Z significantly exceeds 80 mol % (the concentration of 1223E is significantly less than 20 mol %)" is obtained by a result of the precision distillation in about 100 plates, and thereafter, that composition and "a composition in which the concentration of 1223Z is significantly less than 80 mol % (the concentration of 1223E significantly exceeds 20 mol %)" are mixed and adjusted to "the composition in which the concentration of 1223Z is 80 mol % or more (the concentration of 1223E is 20 mol % or less)" as a whole again. Such a way also isn't prevented.

Furthermore, in case of the advanced precision distillation mentioned above, 1223Z and 1223E can be separated from each other. In a usual condition (that is, a distillation condition in about one plate), however, as the concentration (content) of 1223Z rises, mutual separation is hard to be done. Furthermore, when reaching "the composition in which the concentration of 1223Z is 80 mol % (the concentration of 1223E is 20 mol %)", further concentration change substantially doesn't occur. That is, as is clear from the vapor-liquid equilibrium diagram shown in the after-mentioned examples, the composition containing 80 mol % to 99.9999 mol % of 1223Z as the first component and 0.0001 mol % to 20 mol % of 1223E as the second component is an azeotrope (or azeotrope-like) composition where the vapor and liquid phases are substantially the same in composition. Here, the above value of mol % represents percentage of number of moles of each component when regarding total value of the number of moles of 1223Z and 1223E as 100 (that is, represents relative mole percent between two components). As long as the composition is in this range, the composition change is practically hard to occur, even if the liquid composition is treated on open system and further subjected to collecting operation by a simple distillation.

In such a composition range, in case of the composition range where 1223Z as the first component is 90 mol % to 99.9999 mol % and 1223E as the second component is 0.0001 mol % to 10 mol %, the composition in the range is especially preferable, because the vapor and liquid phases are closer in composition.

Furthermore, in case of the composition range where 1223Z as the first component is 95 mol % to 99.9999 mol % and 1223E as the second component is 0.0001 mol % to 5 mol %, concentration fluctuation is quite hard to be caused, because the vapor and liquid phases are further closer in composition. Therefore, the composition in the range is further especially preferable.

The above ranges are examples of preferable composition ranges, and they don't prevent usage of an azeotrope-like composition in a range other than the above composition ranges. According to kind of cleaning objects, required cleaning accuracy, cleaning method, cleaning condition, and a shape of a cleaning machine, if its composition change is permissible for a skilled person, it can be regarded as an azeotrope-like composition where the vapor and liquid phases are substantially closer in composition.

Needless to say, it is one preferred embodiment of the present invention that the azeotrope (or azeotrope-like) composition has high purity with substantially no impurity. Depending on the purpose of use, however, the liquid composition is not necessarily so high in purity. In such a case, it is feasible to use the first component 1223Z and the second component 1223E in which raw materials used for the synthesis of the respective components or by-products thereof remain in small amounts (each component remains in an amount of generally less than 1 wt % relative to the total amount of the azeotrope (or azeotrope-like) composition).

Optionally, "a liquid composition comprising the azeotrope (or azeotrope-like) composition of the present invention and at least one additional component" can be made by adding an additional component in order to improve performance of the azeotrope (or azeotrope-like) composition. As specific examples of the additional component, it is possible to cite cleaning power strengthening agent (surfactant), stabilizing agent (acid acceptor, antioxidant), etc.

As specific examples of the surfactant, it is possible to cite nonionic surfactants as typified by: sorbitan fatty acid esters such as sorbitan monooleate and sorbitan trioleate; polyoxyethlene sorbitol fatty acid esters such as sorbitol tetraoleate of polyoxylethylene; polyoxyethylene glycol fatty acid esters such as polyoxyethylenemonolaurate; polyxyethylene alkyl ethers such as polyoxyethylene lauryl ether; polyoxyethylene alkyl phenyl ethers such as polyoxyethylene nonyl phenyl ether; and polyoxyethylene alkylamine fatty acid amides such as polyoxylethylene oleic amide. These surfactants can be used solely or in combination of two or more kinds thereof. In the case where the azeotrope or azeotrope-like composition is used in a cleaning agent, a cationic surfactant or anionic surfactant may be added in addition to the nonionic surfactant for the purpose of synergistic improvements in cleaning power and interfacial action. The amount of the surfactant added to the azeotrope or azeotrope-like composition varies depending on the kind of the surfactant used, and can be adjusted within the range that does not impair the azeotrope or azeotrope-like properties of the azeotrope or azeotrope-like composition. In general, the amount of the surfactant added to the azeotrope or azeotrope-like composition is in the range of 0.1 mass % to 30 mass %, preferably 0.3 mass % to 5 mass %.

Although the kinds of the stabilizing agent are not particularly limited, as specific examples of the stabilizing agent, it is possible to cite a nitro compound, an epoxy compound, a phenol, an imidazole, an amine, a hydrocarbon, etc. A liquid composition into which such a stabilizing agent is added is particularly useful in case of usage under a severe condition.

As the nitro compound, a well-known compound can be used, and an aliphatic and/or aromatic nitro compound are cited. As specific examples of the aliphatic nitro compound, it is possible to cite nitromethane, nitroethane, 1-nitropropane, 2-nitropropane, etc. As specific examples of the aromatic nitro compound, it is possible to cite nitrobenzene, o-, m- or p-dinitrobenzene, trinitrobenzene, o-, m- or p-nitrotoluene, o-, m- or p-ethylnitrobenzene, 2,3-, 2,4-, 2,5-, 2,6-, 3,4- or 3,5-dimethylnitrobenzene, o-, m- or p-nitroacetophenone, o-, m- or p-nitrophenol, o-, m- or p-nitroanisol, etc.

As specific examples of the epoxy compound, it is possible to cite monoepoxy compounds such as ethylene oxide, 1,2-butylene oxide, propylene oxide, styrene oxide, cyclohexene oxide, glycidol, epichlorohydrin, glycidyl methacrylate, phenyl glycidyl ether, allyl glycidyl ether, methyl glycidyl ether, butyl glycidyl ether, 2-ethylhexyl glycidyl ether, etc.; and polyepoxy compounds such as diepoxybutane, vinylcyclohexene dioxide, neopentyl glycol diglycidyl ether, ethylene glycol diglycidyl ether glycerine polyglycidyl ether, trimethylolpropane triglycidyl ether, etc.

As the phenol, not only a phenolic hydroxyl group but also any of various substituents such as alkyl group, alkenyl group, alkoxy group, carboxyl group, carbonyl group, and halogen atom may be included. As specific examples of the phenol, for example, it is possible to cite monovalent phenols such as 2,6-di-t-butyl-p-cresol, o-cresol, m-cresol, p-cresol, thymol, p-t-butylphenol, o-methoxyphenol, m-methoxyphenol, p-methoxyphenol, eugenol, isoeugenol, butylhydroxyanisole, phenol and xylenol; and divalent phenols such as t-butylcatechol, 2,5-di-t-aminohydroquinone and 2,5-di-t-butylhydroquinone.

As the imidazole, an imidazole having a straight or branched alkyl group, cycloalkyl group, or aryl group of 1 to 18 carbon atoms as a N-position substituent is preferable. As specific examples of such an imidazole, it is possible to cite 1-methylimidazole, 1-n-butylimidazole, 1-phenylimidazole, 1-benzylimidazole, 1-(β-oxyethyl)imidazole, 1-methyl-2-propylimidazole, 1-methyl-2-isobutylimidazole, 1-n-butyl-2-methylimidazole, 1,2-dimethylimidazole, 1,4-dimethylimidazole, 1,5-dimethylimidazole, 1,2,5-trimethylimidazole, 1,4,5-trimethylimidazole, 1-ethyl-2-methylimidazole, etc. These compounds can be used solely or in combination of two or more kinds thereof.

As specific examples of the amine, it is possible to cite pentylamine, hexylamine, diisopropylamine, diisobutylamine, di-n-propylamine, diallylamine, trimethylamine, N-methylaniline, pyridine, morpholine, N-methylmorpholine, triallylamine, allylamine, α-methylbezeylamine, methylamine, dimethylamine, trimethylamine, ethylamine, diethylamine, propylamine, isopropylamine, dipropylamine, butylamine, isobutylamine, dibutylamine, tributylamine, dipentylamine, tripentylamine, 2-ethylhexylamine, aniline, N,N-dimetylaniline, N,N-diethylaniline, ethylenediamine, propylenediamine, diethylenetriamine, tetraethylenepentamine, benzylamine, dibenzylamine, diphenylamine, diethylhydroxylamine, etc. These amines can be used solely or in combination of two or more kinds thereof.

As specific examples of the hydrocarbon, it is possible to cite α-methylstyrene, p-isopropenyltoluene, isoprenes, propadienes, terpenes, etc. These hydrocarbons can be used solely or in combination of two or more kinds thereof.

<Use as Cleaning Agent or Solvent>

The azeotrope (or azeotrope-like) composition (or the liquid composition containing the azeotrope (or azeotrope-like) composition) according to the present invention is suitable for cleaning away a foreign matter, oil or fat, grease, wax, flux, ink, etc. from precision machinery parts, electronic materials (such as printed boards, liquid crystal displays, magnetic recording parts, and semiconductor materials), resin processing parts, optical lens, clothing products and the like. As mentioned above, the azeotrope (or azeotrope-like) composition according to the present invention shows non-flammability as well as adequate flowability and solubility and thus can be used to remove the foreign matter (e.g. particulate matter) by washing away of dissolution. Although there is no particular limitation on the cleaning technique, the precision machinery part or electronic material can be cleaned with the azeotrope (or azeotrope-like) composition (or the liquid composition containing the azeotrope (or azeotrope-like) composition) according to the present invention by immersion washing, wiping using a waste cloth, spray cleaning treatment or the like. These techniques may be used in combination. It is one preferred embodiment of the present invention to put the azeotrope (or azeotrope-like) composition as a cleaning liquid in an ultrasonic cleaning machine, immersing the cleaning target object in the cleaning liquid and perform ultrasonic cleaning treatment of the cleaning target object with the cleaning liquid.

Furthermore, the azeotrope (or azeotrope-like) composition according to the present invention causes almost no composition change even when used in an open system as mentioned above. There is thus obtained a great merit in practical use that it is possible to ensure stable cleaning power with not-so-frequent composition management.

It is feasible to recover the azeotrope (or azeotrope-like) composition according to the present invention by subjecting the used cleaning liquid to recovery and distillation operation, and thereby removing the foreign matter, oil or fat, etc. from the liquid composition. Since ordinary distillation regeneration apparatuses for cleaning agents adopt a simple distillation system, the azeotrope or azeotrope-like composition containing 80 to 99.9999 mol % of 1223Z as the first component and 0.0001 to 20 mol % of 1223E as the second component can be regenerated by a commercially available distillation regeneration apparatus with causing substantially no composition change.

During the distillation operation, the respective two kinds of liquid components, 1223Z and 1223E, maintain the properties of the azeotrope (or azeotrope-like) composition. Therefore, the thus-recovered liquid composition is reusable as the cleaning solvent without a large scale composition adjustment. In the case where the additional component is used as mentioned above, there is a possibility that the additional component may be removed by the distillation operation. In such a case, it is preferable to separately add the additional component.

EXAMPLE

The present invention will be described in more detail below by way of the following examples.

Example 1

In a 50-mL three-neck flask with a septum, a stirrer and a Dimroth condenser for refrigerant flow of −10° C., 1223Z and 1223E were mixed in an amount of 25 mL in total at mole concentrations as shown in Table 1. A synthetic zeolite tube was attached to an upper side of the Dimroth condenser. The flask was immersed in an oil bath and, while stirring the mixture inside the flask, heated until the mixture was refluxed. The composition of the mixture was stabilized after 1 hour or more from the initiation of the reflux. After that, the thus-formed gas phase was sampled by a gastight syringe through the septum. This gas phase sample was analyzed by gas chromatography. Similarly, the thus-formed liquid phase was sampled in an amount of about 1 mL by a polypropylene syringe with a needle, and then, injected into a 2 mL vial cooled with ice water. This liquid phase sample was also analyzed by gas chromatography. The analysis results of the respective compositions are shown in Table 1 in terms of mol % with reference to a preset calibration curve. Furthermore, the analysis results of Table 1 are plotted in FIG. 1 with the composition ratio of the 1223Z liquid phase as the horizontal axis and the composition ratio of the 1223Z vapor phase as the vertical axis. It has been apparent from these results that the composition containing 80 to 99.9999 mol % of 1223Z as the first component and 0.0001 to 20 mol % of 1223E as the second component is azeotrope or azeotrope-like with substantially no difference in composition between the vapor and liquid phases.

TABLE 1

| Composition of Liquid Phase (mol %) | | Compositon of Vapor Phase (mol %) | |
|---|---|---|---|
| 1223Z | 1223E | 1223Z | 1223E |
| 0.0000 | 100.0000 | 0.0000 | 100.0000 |
| 0.0001 | 99.9999 | 0.0003 | 99.9997 |
| 0.0977 | 99.9023 | 0.1422 | 99.8578 |
| 8.0892 | 91.9108 | 10.5780 | 89.4220 |
| 22.4594 | 77.5406 | 28.3963 | 71.6037 |
| 40.8545 | 59.1455 | 47.0634 | 52.9366 |
| 62.6520 | 37.3480 | 68.7152 | 31.2848 |
| 81.4374 | 18.5626 | 84.6842 | 15.3158 |
| 90.1436 | 9.8564 | 91.2545 | 8.7455 |
| 95.4327 | 4.5673 | 96.0024 | 3.9976 |
| 99.9996 | 0.0004 | 99.9998 | 0.0002 |
| 100.0000 | 0.0000 | 100.0000 | 0.0000 |

Example 2

The flash point of mixed liquids of 1223Z and 1223E were measured according to JIS K2265-1 "Determination of Flash Point—Part 1: Tag Closed Cup Method". The measurement of the flash point was performed with the use of an automatic flash point tester atg-81 (manufactured by Tanaka Scientific Limited). The flash point measurement results of the respective liquid compositions are shown in Table 2. There was observed no flash point under atmospheric pressure condition within the azeotrope or azeotrope-like composition range of 1223Z and 1223E.

TABLE 2

| 1223Z (mol %) | 1223E (mol %) | Measurement Result |
|---|---|---|
| 80 | 20 | non-flammable |
| 90 | 10 | non-flammable |
| 95 | 5 | non-flammable |
| 99.9999 | 0.0001 | non-flammable |

Example 3

<Cleaning Test>

A commercially available 25-mL graduated cylinder was cut along the 11-mL graduation line, and a condition where a liquid is apt to vaporize was set. Furthermore, a clean glass rod having a diameter of about 7.2 mm and a length of about 40 mm was provided. After the mass of the glass rod was measured, the glass rod was immersed for 2 minutes in an oil shown in Table 3 below, and then, held in a vertical position and thereby drained for 10 minutes (to remove excessive oil therefrom). After the mass of the glass rod (more specifically, the total mass of the glass rod and the initial adhesive oil) was measured, the glass rod was placed in the above-mentioned graduated cylinder.

Subsequently, as shown in Table 3 below, "the azeotrope-like mixture containing 95.4545 mol % of 1223Z and 4.5455 mol % of 1223E" was poured into the graduated cylinder until the liquid level reached the 10-mL graduation line. The graduated cylinder was vertically positioned in the center of a small-sized ultrasonic cleaner (SW5800 manufactured by Citizen Systems Japan Co., Ltd.) filled with water of 20° C. By the application of ultrasonic waves, the azeotrope-like composition was volatilized with time. At the time the liquid level reached the 8-mL graduation line, the liquid inside the graduated cylinder was analyzed by gas chromatography. As a result, it was found that, in all experiments of Examples 3-1 to 3-5, the liquid composition remained substantially the same before and after the cleaning test even though 2 mL of the composition was volatilized. That is, it has thus been shown that the azeotrope-like mixture used in Example 3 would maintain its azeotrope-like composition without causing substantially composition change of the remaining liquid phase even if the mixture is partially volatilized. Subsequently, the glass rod was dried. The mass of the glass rod (more specifically, the total mass of the glass rod and the remaining oil) was measured. The oil removing rate ([mass of remaining oil]÷ [mass of initial adhesive oil]×100 [%]) was determined based on the measurement results. Furthermore, the surface of the glass rod was observed with a microscope. In every experiment, the oil removing rate was 100%; and there was no oil residue found by microscopic observation so that the microscopic observation result was evaluated as "good". The results are shown in Table 3.

TABLE 3

| | Composition before Test (mol %) | | Composition after Test (mol %) | | | Oil Removing | Microscopic Observation |
|---|---|---|---|---|---|---|---|
| Examples | 1223Z | 1223E | 1223Z | 1223E | Kind of Oil | Rate (%) | Result |
| 3-1 | 95.4545 | 4.5455 | 95.2647 | 4.7353 | cutting oil | 100 | good |
| 3-2 | | | 95.0682 | 4.9318 | turbine oil | 100 | good |

TABLE 3-continued

| Examples | Composition before Test (mol %) 1223Z | 1223E | Composition after Test (mol %) 1223Z | 1223E | Kind of Oil | Oil Removing Rate (%) | Microscopic Observation Result |
|---|---|---|---|---|---|---|---|
| 3-3 | | | 95.3836 | 4.6164 | lubricating oil | 100 | good |
| 3-4 | | | 95.1899 | 4.8101 | silicone oil A | 100 | good |
| 3-5 | | | 95.3717 | 4.6283 | silicone oil B | 100 | good |

cutting oil: Lub Cut B-35 manufactured by Japan Energy Corporation
turbine oil: turbine oil manufactured by JX Nippon Oil & Energy Corporation, ISO viscosity grade: 68
lubricating oil: SUNISO 4GS manufactured by Japan Sun Oil Co., Ltd.
silicone oil A: KF54 manufactured by Shin-Etsu Chemical Co., Ltd.
silicone oil B: KF96 manufactured by Shin-Etsu Chemical Co., Ltd.

The invention claimed is:

1. An azeotrope (or azeotrope-like) composition comprising: (Z)-1,2-dichloro-3,3,3-trifluoropropene (1223Z) and (E)-1,2-dichloro-3,3,3-trifluoropropene (1223E).

2. The azeotrope (or azeotrope-like) composition as claimed in claim 1, wherein the azeotrope (or azeotrope-like) composition contains 80 mol % to 99.9999 mol % of 1223Z and 0.0001 mol % to 20 mol % of 1223E.

3. The azeotrope (or azeotrope-like) composition as claimed in claim 1, wherein the azeotrope (or azeotrope-like) composition contains 90 mol % to 99.9999 mol % of 1223Z and 0.0001 mol % to 10 mol % of 1223E.

4. A liquid composition comprising the azeotrope (or azeotrope-like) composition as claimed in claim 1 and at least one additional component.

5. The liquid composition as claimed in claim 4, wherein the at least one additional component is contained in an amount of 10 ppm to 30 mass % relative to a total amount of the azeotrope (or azeotrope-like) composition.

6. A solvent for cleaning, comprising the azeotrope (or azeotrope-like) composition as claimed in claim 1.

7. A solvent for cleaning, comprising the liquid composition as claimed in claim 4.

8. A method for cleaning a cleaning target object, comprising bringing the azeotrope (or azeotrope-like) composition as claimed in claim 1 into contact with the cleaning target object.

9. A method for cleaning a cleaning target object, comprising bringing the liquid composition as claimed in claim 4 into contact with the cleaning target object.

* * * * *